US005220878A

United States Patent [19]

Himeda

[11] Patent Number: 5,220,878

[45] Date of Patent: Jun. 22, 1993

[54] HULL FOR SAILING SHIP

[75] Inventor: Masami Himeda, Tokyo, Japan

[73] Assignee: Kabushiki Kaisha Naval Engineering, Tokyo, Japan

[21] Appl. No.: 783,149

[22] Filed: Oct. 25, 1991

Related U.S. Application Data

[62] Division of Ser. No. 506,159, Apr. 9, 1990, Pat. No. 5,103,752.

[51] Int. Cl.[5] ..... B63B 35/00

[52] U.S. Cl. ..... 114/39.1; 114/125

[58] Field of Search ..... 114/39.1, 121, 125; 440/76, 111

[56] References Cited

U.S. PATENT DOCUMENTS 2,371,478 3/1945 Steele ..... 114/39.1

3,238,911 3/1966 Pazulski ..... 114/39.1

*Primary Examiner*—Edwin L. Swinehart

*Attorney, Agent, or Firm*—Keck, Mahin & Cate

[57] ABSTRACT

A hull for sailing ship makes it possible to sail mostly by sail and by engine when necessity arises. An auxiliary propulsion engine is installed within a ballast portion protruding downward from the bottom of the hull body, so that the auxiliary propulsion engine can also be used as ballast.

8 Claims, 4 Drawing Sheets

HULL FOR SAILING SHIP

This is a divisional of application Ser. No. 07/506,159, filed Apr. 9, 1990, now U.S. Pat. No. 5,103,752, Apr. 14, 1992.

BACKGROUND OF THE INVENTION

1. Field of the Invention

This invention relates to a hull for a sailing ship which makes it possible to sail under a sail and by an engine when necessity arises.

2. Prior Art of the Invention

As this type of a ship has a sailing mast, it is necessary for such ship to have lumps such as lead, concrete, etc. as ballast laid down on the lower part of the hull in accordance with the dimension of the sail, so that the ship would not turn over sideways when a strong wind blows.

Also, this type of a ship generally has an auxiliary propulsion engine for use when the ship sails in and out of a harbor. If this auxiliary engine is large, the ballast also must be made large in order to lower the gravity of the ship. Therefore, the space in the hull is greatly restricted. In order to secure a space of a predetermined size for living, an engine of a small horse power was used in the conventional ship.

However, if it happens that wind ceases when the ship is sailing far out at sea under a sail or that a heavy storm makes it impossible for the ship to continue sailing under a sail, this auxiliary propulsion engine is the only power to rely upon. However, since the engine is small in horse power because of the reason mentioned above, a desired speed is unavailable. This often invites such risks as that the ship can not return to the harbor before sun set and that the ship is involved in storm.

SUMMARY OF THE INVENTION

It is therefore a general object of the present invention to provide a hull for a sailing ship able to have a large sail without sacrificing an internal space of the hull even if an engine of a large horse power is installed.

The feature of the present invention is that in a hull for a sailing ship which mostly sails under a sail, an auxiliary propulsion engine is installed within a ballast portion protruding downward from the bottom of the hull body, and said auxiliary propulsion engine is used as ballast.

Another feature of the present invention is that a fuel tank is installed within the ballast portion.

A further feature of the present invention is that sea water contained in a sea water tank installed within the ballast is increased or decreased in accordance with fuel capacity in a fuel tank in order to make a total weight of the content of the fuel tank and the content of the sea water tank generally equal.

A still further feature of the present invention is that a water-current pipe is provided as such that a water-current inlet port is formed in a bow side of said ship and water flowed in through the water-current inlet pipe is flowed out through a water-current outlet port formed in a stern side of the hull.

A yet further feature of the present invention is that a pair of said water-current pipes are disposed on both sides of said ballast portion.

A still yet further feature of the present invention is that said pair of water-current pipes are of a closed sectional structure formed at a connected portion between said ballast portion and said bottom of said hull body and extending in the longitudinal direction along both sides of said ballast portion.

An additional feature of the present invention is that a cover member for controlling the opening dimension of a flow passage is provided to a pair of water-current pipes.

A still additional feature of the present invention is that said pair of water-current pipes are provided at said outlet ports with a sub-rudder, respectively.

BRIEF DESCRIPTION OF THE DRAWINGS

FIGS. 1 and 2 show the first embodiment of a hull for a sailing ship according to the present invention, wherein:

FIG. 1 is a diagrammatical view showing a side of the hull, and

FIG. 2 is a sectional view of a ballast portion taken along the width direction of the hull.

FIGS. 3 and 4 show the second embodiment of a hull for a sailing ship according to the present invention, wherein:

FIG. 3 is a diagrammatical view like FIG. 1, and

FIG. 4 is a sectional view like FIG. 2.

DETAILED DESCRIPTION OF THE EMBODIMENT

Figure 1:
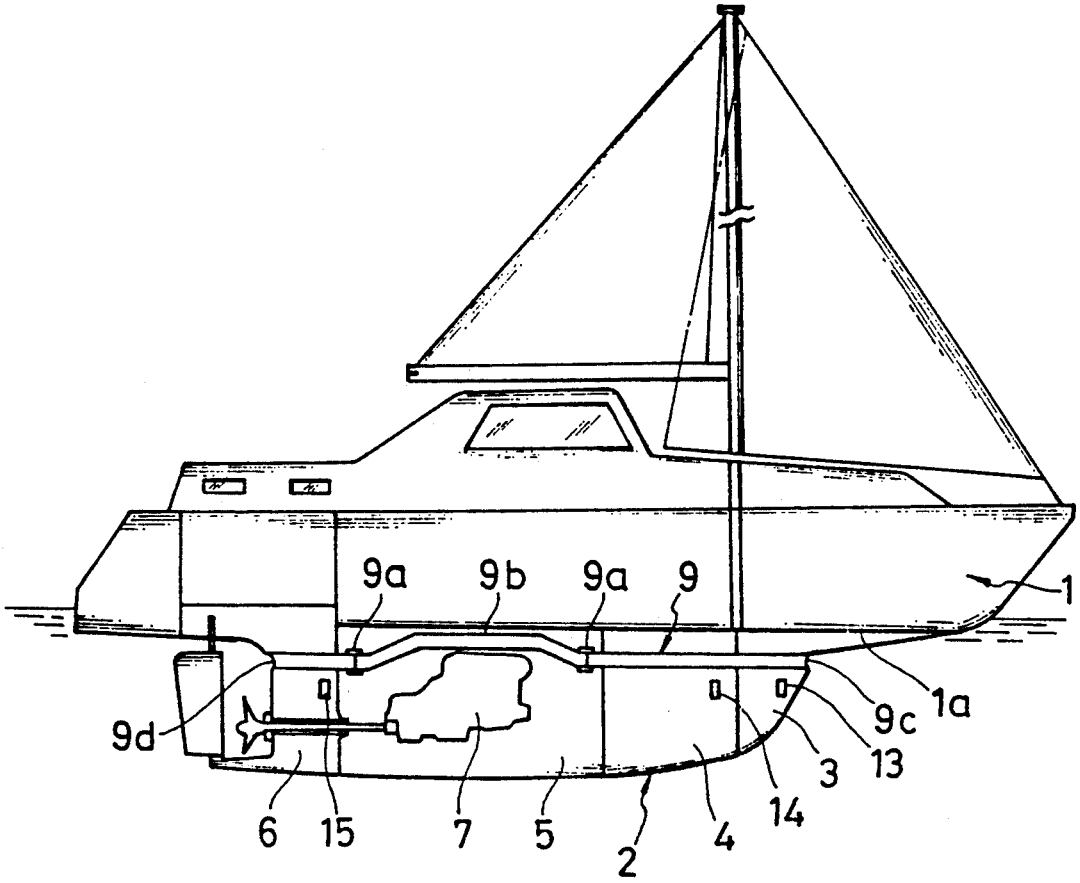

The embodiment of the present invention will be described hereunder with reference to the drawings.

In the drawings, the reference numeral 1 denotes a hull. A predetermined size of ballast portion 2 protruding downward is formed on a bottom 1*a* of the hull body 1. The ballast portion 2 is provided with a sea water tank 3, a fuel tank 4, an engine room 5, and a fresh water tank 6 defined in this order from a bow side.

The sea water tank 3 and the fuel tank 4 are provided therein sensors 13 and 14 adapted to detect liquid quantity. By detecting the liquid quantity within the respective tanks 3 and 4 by the sensors 13 and 14, sea water is charged into and discharged from the fresh sea water tank 3 in accordance with consumed amount of fuel contained in the fuel tank 4 by a control unit (not shown) so that a total weight of the content of the sea water tank 3 and the content of the fuel tank 4 would normally become generally equal.

Figure 2:
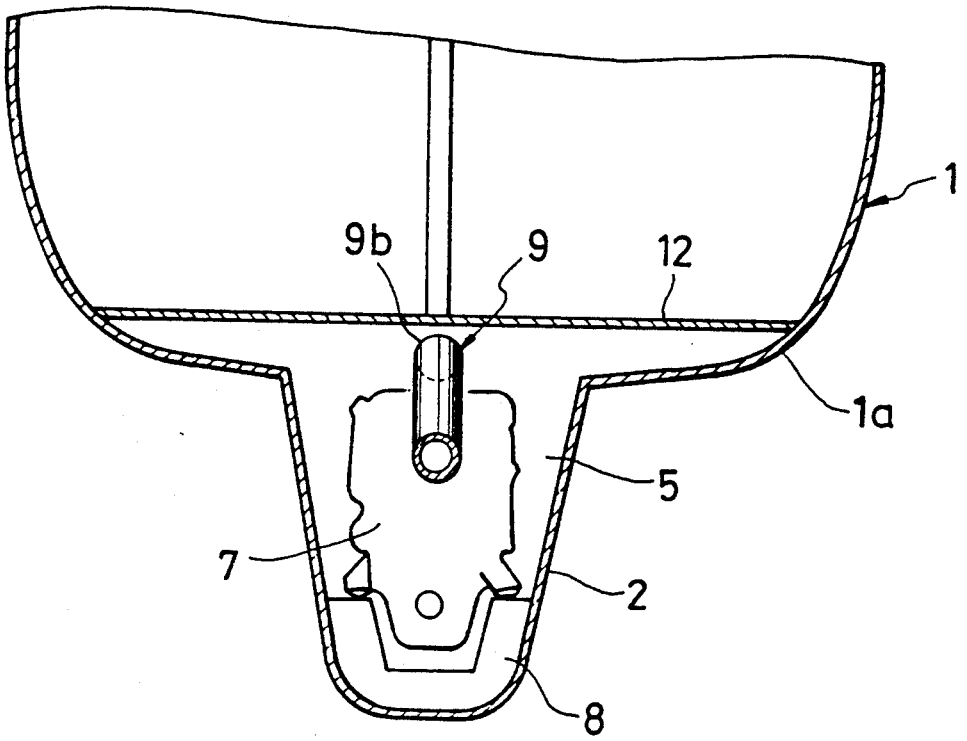

Further, an auxiliary propulsion engine 7 is supported within the engine room 5 through a mount portion 8 as shown in FIG. 2. The entire engine 7 is completely contained within the ballast portion 2.

Furthermore, the fresh water tank 6 is also provided with a sensor 15 adapted to detect liquid quantity. This sensor 15 detects the liquid quantity in the fresh water tank 6 and in accordance with the consumed quantity of fresh water by an apparatus (not shown), the fresh water is refilled by a fresh water generator (not shown) to set the weight to a predetermined value.

Within this ballast portion 2, a water-current pipe 9 is disposed in the longitudinal direction at the central portion in the width direction passing an upper side of the auxiliary propulsion engine 7. The water-current pipe 9 has a central portion 9*b* removable by a joint flange 9*a*. The water-current pipe 9 is provided on its bow side with a water-current inlet port 9*c* and on its stern side with a water-current outlet port 9*d*.

In this way, by virtue of the provision of the auxiliary propulsion engine 7, the sea water tank 3, the fuel tank 4, the fresh water tank 6, etc. within the ballast portion 2, the weight of the ballast portion 2 is increased to thereby improve the sailing stability. As a result, the sail dimension can be made large.

Moreover, by virtue of the provision of the auxiliary propulsion engine 7, etc. within the ballast portion 2, a cabin can be made larger than that of the prior art.

Furthermore, by making the width of the ballast portion 2 large, a flooding dimension can be made large. As a result, there can be considered that the propulsion resistance of the ship is increased. However, by virtue of the provision of the water-current pipe 9, the increase of the propulsion resistance of the ship can be reduced.

That is, the difference in propulsion resistance is shown hereunder by showing two cases; one case where the water-current pipe 9 is provided and the other where the water-current pipe 9 is not provided.

For the convenience of easy understanding, the length H of the ballast portion 2 is divided into 10 equal parts (h=H/10). In case the hull has the following flooding dimension;

length of girth: G

Simpson's coefficient: s the flooding dimension S becomes as follows;

| | G | s | G · s |
|---|---|---|---|
| 1 | 1.15 | 4 | 4.6 |
| 2 | 1.42 | 2 | 2.84 |
| 3 | 1.55 | 4 | 6.2 |
| 4 | 1.78 | 2 | 3.56 |
| 5 | 1.84 | 4 | 7.36 |
| 6 | 1.9 | 2 | 3.8 |
| 7 | 1.9 | 4 | 7.6 |
| 8 | 1.86 | 2 | 3.72 |
| 9 | 1.73 | 4 | 6.92 |
| 10 | 1.7 | 1 | 1.7 |
| | | Σ | 48.3 |

$S = h/3 \times 48.3 = 11.945\ m^2$ wherein: δ: specific gravity of water t: temperature of water $\lambda$: $0.1392 + 0.258/(2.68 + H)$ if the speed is represented by Vk, the friction resistance Rf becomes as follows;

<in case water-current pipe is not provided> when the speed of the ship is 15 knots, $$Rf = 0.2973\delta\lambda\{1 + 0.0043(15 - t)\} \times SVK^{1.825}$$

$$= 0.2973 \times 1.025 \times 0.165\{1 + 0.0043(15 - 15)\} \times 11.745 \times 15^{1.825}$$

$$= 82.6\ kg$$

when the speed of the ship is 10 knots, $$Rf = 0.05 \times 1.004 \times 1645.2$$

$$= 39.4\ kg$$

<in case water-current pipe is provided>

$S = 11.945 - 2.3 = 9.645\ m^2$ when the speed of the ship is 15 knots, $Rf = 67.8\ kg$ when the speed of the ship is 10 knots, $Rf = 32.4\ kg$ In this embodiment, by virtue of the provision of the water-current pipe 9, there is generated a difference in friction resister of 14.8 kg in 15 knots of ship speed and 7 kg in 10 knots of ship speed. Therefore, disturbance for the propulsive force of the ship due to increase of the flooding dimension can be reduced.

Furthermore, the liquid quantity in the respective tanks 3, 4 is detected by the corresponding sensors 13, 14, and the sea water in the sea water tank 3 is increased or decreased in accordance with the capacity of fuel contained in the fuel tank 4. By this, as the total weight of the content of the fuel tank 4 and the content of the sea water tank 3 is normally made generally equal, stability can always be maintained.

Figure 3:
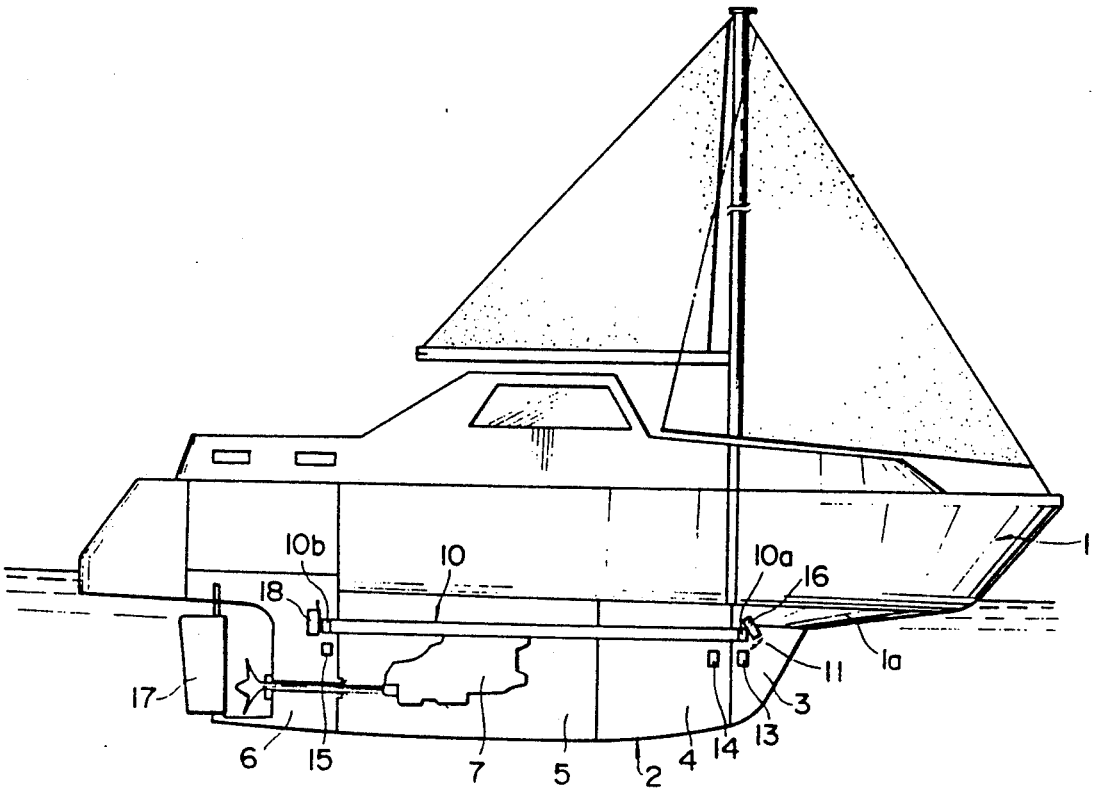
Figure 4:
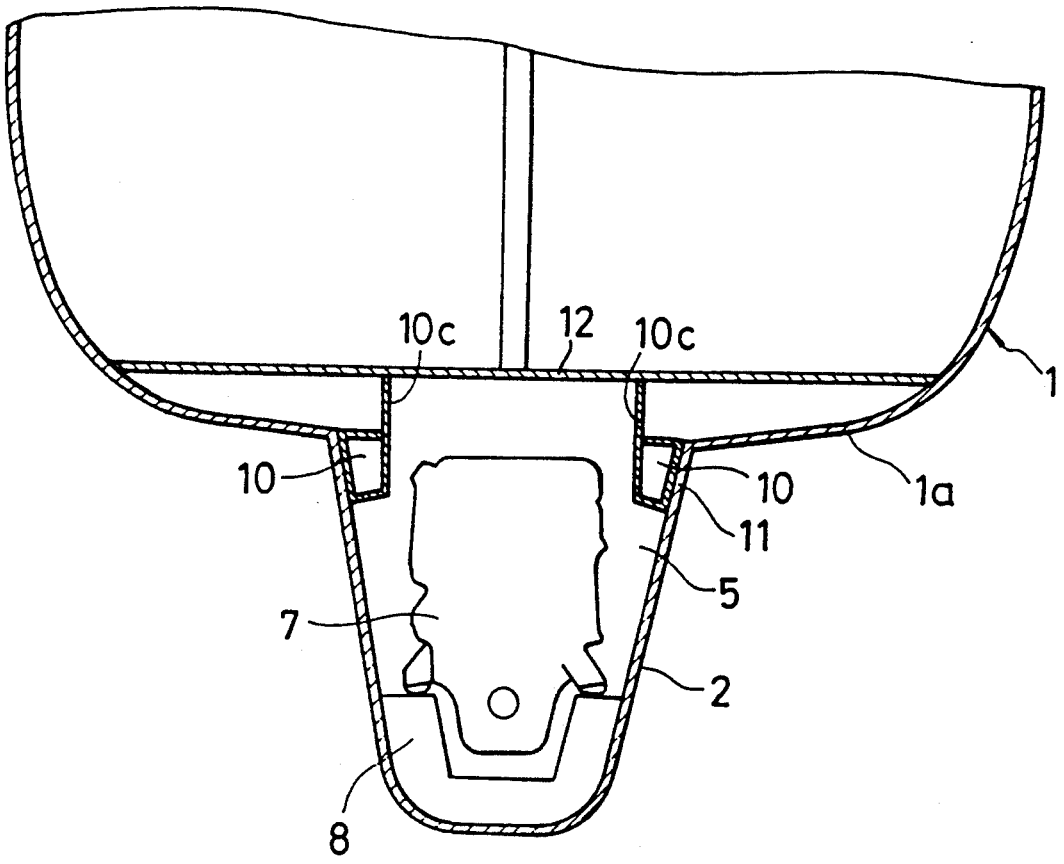

FIGS. 3 and 4 show the second embodiment of the present invention.

This embodiment is different from the first embodiment in the respect that a pair of said water-current pipes 10 are provided at the connected portion 11 between ballast portion 2 and the bottom 1*a* of the hull body 1 on both sides of the auxiliary propulsion engine 7.

More specifically, the pair water-current pipes 10 is formed of a closed sectional structure disposed on the connected portion 11 between the ballast portion 2 and the hull 1 and is curved along an external wall of the ballast portion 2. And the water-current pipes 10, as shown in FIG. 3, are provided with water-current inlet ports 10*a* formed on the bow side of the water-current pipes 10 and with water-current outlet ports 10*b* on the stern side thereof. Furthermore, an extending wall 10*c* of the water-current pipes 10 are connected to a double bottom portion 12 as shown in FIG. 4.

Also, each of the water-current pipes 10 is provided with a cover member 16 rotatably disposed to the water-current inlet port 10*a* and adapted to control the opening dimension of the water current input port 10*a*. This cover member 16 is pivoted by a control device (not shown) so as to optionally control the dimension of the opening.

In this way, as heavy substances such as auxiliary propulsion engine 7, oil, water, etc. are loaded in the ballast portion 2, the stability is more improved. On the other hand, a large stress is concentrated on the connecting portion 11 between the ballast portion 2 and the hull 1. However, as this portion is formed in the closed sectional structure and its extension wall 10*c* is jointed to the double bottom portion 12, there can be obtained a sufficient strength.

Furthermore, a pair of water-current pipes 10 are provided and such water-current pipes 10 are disposed on both sides of the ballast portion 2. By virtue of the foregoing arrangement, as the auxiliary propulsion engine 7 does not become an obstacle, the water-current pipes 10 do not require an elbow portion on the midway thereof. As the resistance of water passing through the water-current pipes 10 is small, disturbance of the propulsion force of the ship can be further reduced.

Moreover, as the pair of water-current pipes 10 passes by the sides of the auxiliary propulsion engine 7, it is no more required to remove the central portion 9*b* as in the first embodiment and do not become an obstacle when the auxiliary propulsion engine 7 is carried in and carried out, the work for carrying in and carrying out the auxiliary propulsion engine 7 can be performed with ease.

Furthermore, if it is designed such that the dimension of the openings of the water-current inlet ports 10*a* of the water-current pipes 10 by pivoting the cover member 16 in order to change the flow resistance of the water-current pipes 10, the advancing direction of the ship can be changed. If this steering force is combined with a steering force of a rudder 17, the advancing direction can be changed with ease. Moreover, if the difference in flow resistance in the pair of water-current pipes 10 is made large to made the steering force large, it can be expected that the rudder 17 is omitted. Also, if operation becomes impossible due to disorder in a state where the water-current inlet port 10*a* of one of the water-current pipes 10 is closed by the cover member 16, the ship can not be steered in a desired direction. In this case, therefore, the other water-current inlet port 10*a* is closed by the cover member 16. By this, resistance is somewhat increased but the ship can be sailed in a desired direction by the rudder 17.

Furthermore, as is shown in FIG. 3, the advancing direction of the ship can also be changed in such a manner as that instead of the cover member 16 or together with the cover member 16, a sub-rudder 18 is provided to both outlet ports 10*b* respectively and the direction of water flowing out from the water-current outlet ports 10*b* through the water-current pipe 10 is changed.

When the shape of the ship is made in twin bodies, the pair of water-current pipes may be provided to each of them with the same effects.

As described in the foregoing, according to the present invention, there can be provided a hull for a ship in which even if an engine of a large horse power is installed, a large sail dimension is still obtainable without reducing the internal space of the ship.

Furthermore, by providing the sea water tank and the fuel tank in the ballast portion, the stability of the ship body can be improved.

Moreover, by increasing or decreasing the sea water within the sea water tank in accordance with the capacity of the fuel contained in the fuel tank, the stability can always be maintained.

Furthermore, as the heavy substance of the auxiliary propulsion engine is loaded in the ballast portion as a ballast, a heavy stress is concentrated on a connecting portion between the ballast portion and the bottom portion of the ship body. However, as this portion is formed in a closed sectional structure, there can be obtained a sufficient strength.

Also, there can be considered that the propulsion resistance of the ship is increased because the flooding dimension becomes large due to large width of the ballast portion. However, by providing the water-current pipes, the increase of the propulsion resistance can be minimized.

Moreover, as the pair of water-current pipes are disposed to both sides of the ballast portion and the auxiliary propulsion engine is not disturbed. Accordingly, it is no more required to provide an elbow portion on a midway of the water-current pipes. As the resistance of water passing through the water-current pipes is small, the propulsion resistance of the ship can further be reduced.

Furthermore, as a pair of water-current pipes pass by the sides of the auxiliary propulsion engine, they do not become an obstacle when the auxiliary propulsion engine is carried in and carried out. Therefore, the work for carrying in and carrying out the auxiliary propulsion engine can be preformed with ease.

Moreover, by providing a cover member for controlling the dimension of the openings of the pair of water-current pipes, the ship can be steered.

Furthermore, by providing a sub-rudder to the water-current outlet ports of the pair of water-current pipes respectively, the ship can be steered.

What is claimed is:

1. A sailboat hull comprising a keel portion extending lengthwise of the hull in a forward and rearward direction wherein an intermediate portion of the length of said keel portion is expanded widthwise across said keel portion substantially throughout the height of the keel portion, an auxiliary engine compartment in a central part of said keel portion, wherein an auxiliary engine is substantially entirely accommodated within said keel portion.

2. A sailboat hull according to claim 1, wherein one of a fuel tank and a fresh water tank is disposed in a forward part of said keel portion, forward of the auxiliary engine compartment and the other of said fuel tank and said fresh water tank is disposed in a rearward part of said keel portion, and wherein said keel portion adjacent said fuel tank further comprises a sea water tank.

3. A sailboat hull according to claim 2, wherein said keel portion comprises a flow water pipe extending lengthwise thereof, adapted to intake sea water from a forward end of said keel portion and to discharge the sea water from a rearward end thereof for reducing propulsive resistance.

4. A sailboat hull according to claim 3, wherein a pair of said flow water pipes are disposed on left and right sides of said keel portion, respectively.

5. A sailboat hull comprising a keel portion extending lengthwise of the hull in a forward and rearward direction, wherein an auxiliary engine compartment is disposed in said keel portion, and an auxiliary engine is substantially entirely accommodated within said keel portion, said keel portion further comprising a flow water pipe extending lengthwise and adapted to intake sea water from a forward end of said keel portion and to discharge the sea water from a rearward end of said keel portion for reducing propulsive resistance.

6. A sailboat hull according to claim 5, wherein a pair of said flow water pipes are disposed in said keel portion on left and right sides thereof.

7. A sailboat hull according to claim 5, wherein said flow water pipe is disposed lengthwise in a central part of said keel portion.

8. A sailboat hull according to claim 5, wherein one of a fuel tank and a fresh water tank is disposed forward of said keel portion and auxiliary engine compartment and the other of said fuel tank and said fresh water tank is disposed rearward of said keel portion, said keel portion adjacent said fuel tank further comprising a sea water tank.

* * * * *